United States Patent [19]

Moscony et al.

[11] 4,126,510

[45] Nov. 21, 1978

[54] ETCHING A SUCCESSION OF ARTICLES FROM A STRIP OF SHEET METAL

[75] Inventors: John J. Moscony; George S. Gadbois, both of Lancaster, Pa.

[73] Assignee: RCA Corporation, New York, N.Y.

[21] Appl. No.: 840,037

[22] Filed: Oct. 6, 1977

[51] Int. Cl.[2] ..... C23F 1/02

[52] U.S. Cl. ..... 156/626; 156/345; 156/640; 156/644; 156/659

[58] Field of Search ..... 356/108, 109, 113, 199; 204/129.2; 156/626, 627, 640, 641, 644, 654, 659, 345

[56] References Cited

U.S. PATENT DOCUMENTS

| | | | |
|---|---|---|---|
| 3,032,753 | 5/1962 | Knapp et al. | 156/905 X |
| 3,503,817 | 3/1970 | Radimer | 156/626 |
| 3,553,052 | 1/1971 | Jubb | 156/626 X |

OTHER PUBLICATIONS

IBM Technical Disclosure Bulletin, vol. 17, No. 7, Dec. 1974, Multiple Sensor, End-Point Etch Detect System by Dhaliwal et al., pp. 1946–1947.

IBM Technical Disclosure Bulletin, vol. 15, No. 3, Aug. 1972, Detection of Etch Completion of Interconnection Metallurgy, by Ganguke et al., pp. 713–714.

*Primary Examiner*—William A. Powell

*Attorney, Agent, or Firm*—E. M. Whitacre; G. H. Bruestle; L. Greenspan

[57] ABSTRACT

When precision etching a succession of articles from a strip of metal having random variations in thickness and moving along a prescribed path, the thickness of the metal strip is monitored, and the etching step is adjusted in response to the monitored thickness to compensate for the thickness variations.

9 Claims, 3 Drawing Figures

ETCHING A SUCCESSION OF ARTICLES FROM A STRIP OF SHEET METAL

BACKGROUND OF THE INVENTION

This invention relates to a novel method for precision etching of a succession of articles from a moving metal strip.

The method is particularly useful for preparing flat apertured masks which are subsequently formed and installed in color television picture tubes.

Precision etching is employed to produce articles with complex arrays of apertures therein, where the sizes and shapes of the apertures are to be held within very narrow size tolerances. An apertured mask, which is an important part of a shadow-mask-type picture tube used in color television receivers, is one such article. The production of flat apertured masks by photoexposure and precision etching has been described previously. In a typical process, light-sensitive coatings are applied to both major surfaces of a continuous strip of thin sheet metal. In one practice, both major surfaces of a cold-rolled-steel strip about 0.15 mm (6 mils) thick and about 550 mm (22 inches) wide are coated with a dichromate-sensitized casein composition. The light-sensitive coatings are exposed to a succession of actinic light images, as by contact-printing exposure, to render the exposed portions thereof less soluble in water. The exposed coatings are developed to remove the more-soluble unexposed portions, thereby producing a succession of stencils on each surface of the strip, and then baked to render the retained, less-soluble, exposed portions etch resistant. Then, the strip with the etch-resistant stencils thereon is advanced through an etching station where it is selectively etched from both surfaces with an etching solution that is sprayed on the strip. The strip continues to advance beyond the etching station through successive stations where the strip is rinsed, the stencils are removed, the strip is dried and the light transmissions through the masks are monitored. The flat masks produced by the foregoing method have an array of apertures therein, which apertures are usually round holes or rectangular slits, but may be of any desired shape. Round apertures are typically about 0.30 to 0.38 mm (12 to 15 mils) in diameter, and rectangular apertures are typically about 0.13 to 0.20 mm (5 to 8 mils) wide by about 0.76 to 1.27 mm (30 to 50 mils) high. The flat mask is formed to a desired shape and detachably mounted in the faceplate panel of the tube. The formed and mounted mask is then used as an optical master for photographically depositing one or more screen structures of the tube. The mask is also used to shadow the scanning electron beams during the operation of the picture tube.

The sizes and shapes of the apertures are critical towards reliably and reproducibly implementing these functions. Many factors affect the sizes of the apertures in the mask. Some important process variables relating to the photoexposure and etching steps that are now carefully controlled are (1) temperature of the etching solution, (2) density of the etching solution, (3) pressure applied to spray the etching solution, (4) thickness of the stencils, (5) baking temperature of the stencils, (6) size of the apertures in the developed stencils, and (7) conditions for photoexposing light-sensitive coating. Even though these many process controls are applied, there is still a need to reduce the variation in aperture sizes in the etched masks.

We have found that: (a) the prior photoexposure-and-etching process produces mask apertures whose sizes, and therefore light transmissions of the masks, are very dependent on small changes in the thickness of the metal strip, and (b) the ordinary thickness range of the metal strip received from the metal supplier can produce variations in aperture sizes which are greater than can be tolerated by the user of the mask. For example, 0.025 mm (0.1-mil) change in the thickness of a 0.150 mm (6-mil)-thick steel strip can cause a change of 0.3% in the light transmission of the etched mask, or about one third of the allowable etching tolerance. Steel strip, as received from the supplier, may have a thickness variation of ±0.0125 mm (±0.5 mil), which would, if uncompensated for, produce masks with a greater than allowable variation in transmission.

Where these wide variations in strip thickness exist, the masks must be more thoroughly inspected and a substantial proportion of the etched masks must be discarded as being out of tolerance. Frequently, masks selected for retention are classified into one of several groups according to light transmission so that wider ranges of aperture sizes can be tolerated through other compensations made later in the manufacturing processes.

SUMMARY OF THE INVENTION

The novel method comprises monitoring the strip thickness and suitably adjusting the amount of etching occurring in the etching station in response to the monitored thickness. In one form of the invention, the etching time is adjusted. In a preferred embodiment, thickness of the metal strip along its direction of movement is monitored and the speed of the metal strip passing through the etching station is adjusted. An inverse relationship is used; that is, the thicker the strip, the slower the speed of the strip as it passes through the etching station. Other parameters which affect the aperture sizes can be adjusted in response to the thickness measurement, such as the pressure and/or turbulence of the etching solution, or the relative chemical activity of the etchant.

By practicing the novel method, variations in aperture sizes in the etched article due to variations in thickness of the metal strip can be substantially reduced and even completely compensated for. This results in a reduction in the number of articles with out-of-specification apertures and light transmissions, with a consequent increase in the yield of the process. The thickness measurements are preferably done just prior to the etching step with the control information fed forward to adjust the desired process parameter or parameters at the etching station. Since the thickness varies slowly over the length of the steel strip, the thickness measurement can be made after etching and the control information fed back to the etching station. The novel method can be practiced along with any of the process controls previously used.

DETAILED DESCRIPTION OF THE PREFERRED EMBODIMENTS

Figure 1:
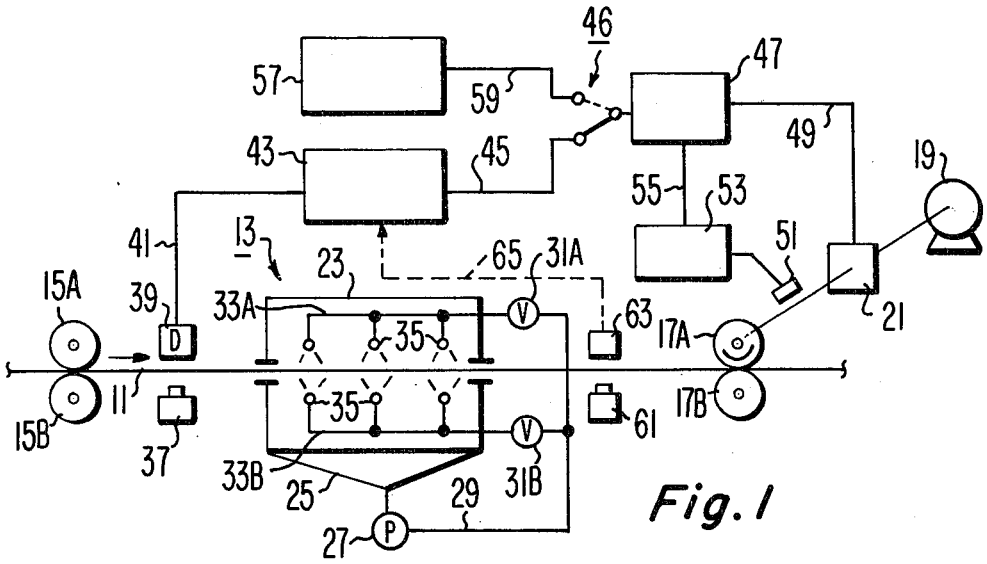
FIG. 1 is a schematic representation of an apparatus for the preferred paractice of the novel method.

FIG. 1 shows a metal strip 11 to be etched moving through an etching station 13 from left to right as shown in the figure. The strip 11 moves at about 1625 to 2125 mm (65 to 85 inches) per minute. The strip 11, which carries etch-resistant stencils on both major surfaces thereof, is supported between first and second pairs of rollers 15*a*, 15*b* and 17*a*, 17*b*. The strip 11 is moved by the rotation of the upper roller 17*a*, which is mechanically driven by a motor 19 through a variable speed reducer 21. The etching station 13 comprises a closed chamber 23, the bottom of which drains to a sump 25 below the strip 11. Liquid etchant in the sump is pumped by a pump 27 through piping 29 through top and bottom valves 31A and 31B through top and bottom headers 33A and 33B respectively and sprayed out of nozzles 35 therein against the moving strip 11. The etchant is sprayed with a pressure in the range of 10 to 30 pounds per square inch. The spray etchant then drains to the sump 25. The above-described apparatus for etching from both sides of a horizontally oriented strip is used in the art, and a further detailed description thereof is therefore unnecessary.

The apparatus shown in FIG. 1 also comprises an x-ray source 37, which directs an x-ray beam from below through the moving strip in advance of the etching station 13. An x-ray detector 39 is positioned on the opposite side of the strip 11 to receive x-rays that have passed through the strip 11 and to convert received x-rays into a train of electrical signals. A preferred x-ray source and detector is the Sheffield Measuray X-ray Thickness Gage IC-60 marketed by Bendix A and M Division, Dayton, Ohio. The instruction manual for that unit describes the source as a steel, lead-lined tank filled with insulating oil and containing a Coolidge-type x-ray tube, an anode transformer and a filament transformer. There are also cooling coils to remove heat from the tank. In the preferred embodiment, the tube is operated at about 25 kilovolts, providing x-rays with a distribution peaking at about 0.0005 micron in wavelength. Higher voltages produce distribution of x-rays peaking at shorter wavelengths and having greater penetrating power. The instruction manual for that unit describes the detector 39 as comprising a light-tight housing having an x-ray transparent window through which x-rays pass to a layer of sodium iodide or cadmium sulfide crystals which emit light when struck by x-rays. The intensity of the emitted light is proportional to the intensity of the x-rays impinging on the layer. Since the x-ray intensity is a function of the thickness of the strip 11, the intensity of the emitted light is also a function of the thickness of the strip 11. The emitted light is detected by, and amplified by, a photomultiplier tube producing a primary electrical signal which is representative of the attenuated and detected x-ray beam.

The electrical signal is fed through a lead 41 to a signal processor circuit represented by the box 43, which converts the primary electrical signals into a train of secondary electrical signals, which in turn is fed through a lead 45 and a switch 46 to a control circuit which is represented by the box 47. The control circuit 47 includes a memory portion and a signal processing portion so arranged to accept a succession of secondary signals, to produce a most-recent running average secondary signal for a prescribed most-recent time interval, to compare the most-recent running average secondary signal with the running average secondary signal used to produce the last command signal and to generate a command signal of a given magnitude when the difference between those two running average signals is greater than a prescribed magnitude. The command signal is fed through a lead 49 to change the output speed on the variable speed reducer 21 to a desired value. The output speed of the speed reducer 21 is sensed by a sensor 51 and circuit represented by the box 53, and that information is fed through a lead 55 to the control circuit 47 to confirm that the command signal has been obeyed. The control circuit 47 generates its command signal from averages so that the effects of noise and spurious signals are minimized. Also, the control circuit provides control signals providing substantially uniform increments of speed change but differing in the time intervals between speed changes. The apparatus shown in FIG. 1 may include an external source of secondary signals which are representative of strip thickness as represented by the box 57 and connected into the system through a lead 59 and the switch 46. Also, the apparatus may include other controls integrated into the system. For example, as shown in FIG. 1, the light transmission of the etched article in the strip may be monitored by directing a light beam from a light source 61 through the etched strip 11, detecting the transmitted beam with a light detector 63 on the opposite side of the strip 11. The electrical signals from the light detector 63 are fed through a lead 65 directly or indirectly to the control circuit 43, where the command signal may be modified in response to the signals generated by variations in light transmission.

The various circuits and components employed in the system shown in FIG. 1 are all known in the art, as is their mode of operation. Other circuits and components and arrangements, all known, can be substituted for what is described with respect to FIG. 1. For example, instead of a feed-forward control, the x-ray source and detector can be located along the strip 11 on the exit side of the etching station. In this case, it is desirable that the strip be rinsed and dried piror to the thickness monitoring.

More sophisticated systems may be provided by the novel method. Such a system is exemplified in the apparatus shown in FIGS. 2 and 3. In that system, the thickness is monitored at three places across the width of the moving strip. The information from each detector is then used to control the pressure or the spray velocity of the etchant in each of three headers which spray etchant over prescribed overlapping areas of the strip where the corresponding thicknesses were monitored.

Figure 2:
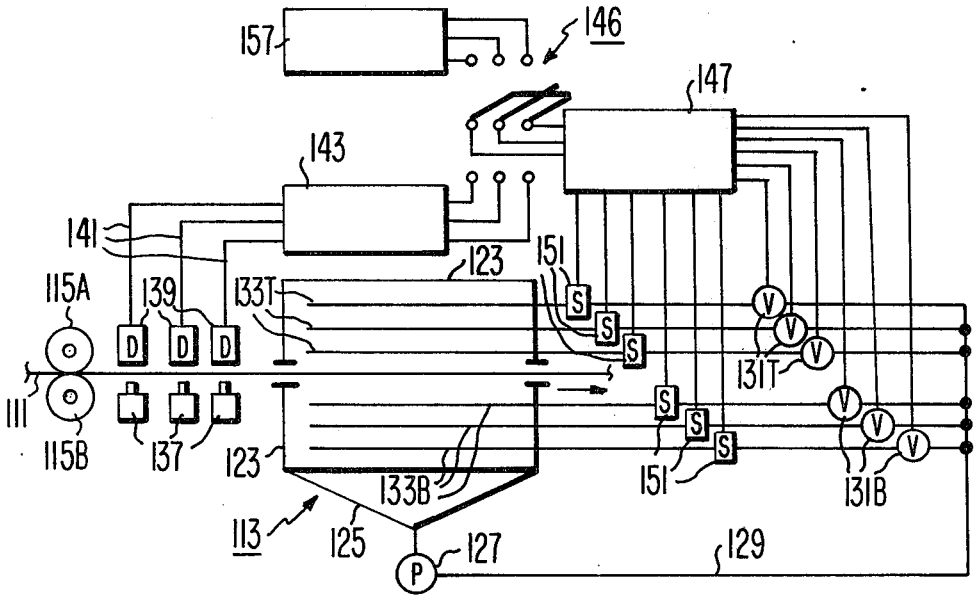
FIG. 2 is a schematic representation of an alternative apparatus for practicing the novel method.
Figure 3:
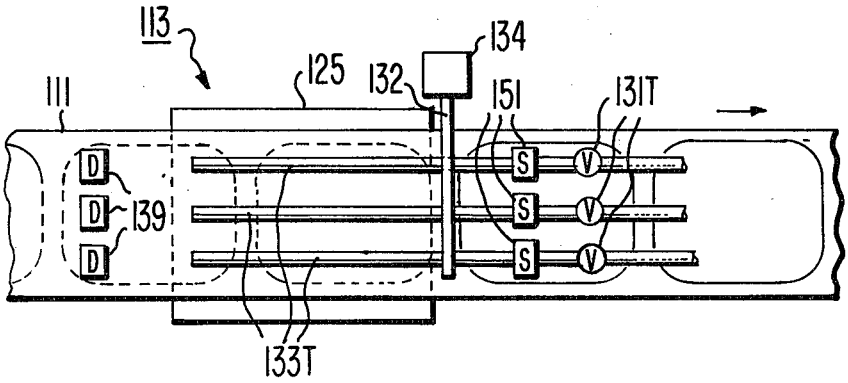
FIG. 3 is a partially schematic plan view of a metal strip passing through the etching station of FIG. 2 showing the transverse locations of the detectors and the spray headers over the strip.

Specifically, FIGS. 2 and 3 show an apparatus comprising a strip 111 moving through an etching station 113 from left to right, as shown in the figures. The strip 111, which carries etch-resistant stencils on both major surfaces, is supported between a first pair of rollers 115A and 115B and a second pair of rollers (not shown), as in FIG. 1. The etching station 113 comprises a closed chamber 123, the bottom of which drains to a sump 125 below the strip 111. Liquid etchant in the sump 125 is pumped by a pump 127 through piping 129 through three upper variable pressure valves 131T and three lower variable pressure valves 131B to three top headers 133T and three bottom headers 133B respectively. Each header is aligned longitudinally; that is, in the direction of movement of the strip 111. The upper headers are substantially equally spaced transversely over the strip 111, and the lower headers are substantially equally spaced transversely under the strip 111. Each header has a plurality of spray nozzles therein through which etchant may be sprayed onto the strip 111. Also, each header is connected through a rocker arm 132 to a rocker mechanism 134 adapted to rotate the header about its own longitudinal axis so as to sweep the sprayed etchant therefrom transversely across the strip 111. The sprayed etchant then drains to the sump 125.

The apparatus shown in FIGS. 2 and 3 also comprises three x-ray sources 137, which direct x-ray beams through the moving strip, the three x-ray detectors 139, one opposite each of the x-ray sources 137, as in FIG. 1. The three combinations of x-ray source and detector (each of which may be the same as the combination described with respect to FIG. 1) are located in a transverse line ahead of the etching station 113 and are substantially equally spaced across the strip. Each combination generates a train of primary signals which are representative of the attenuating x-ray beam transmitted through the strip in one of the three areas of the strip 111. The three primary signals are fed through leads 141 to a signal processor circuit which converts the train of primary signals to three trains of secondary signals which are fed through a switch 146 to a control circuit 147. The control circuit processes each of the three trains of signals as in the circuit 47 of FIG. 1, producing three spearate pairs of command signals, which command signals are fed to the upper and lower variable control valves 131T and 131B, which in turn regulate the pressure and/or velocity of the etchant passing therethrough to the right, center and left pairs of spray headers 133T and 133B. The apparatus may include an external source 157 of synthetic secondary signals which are representative of strip thickness. The pressure and/or velocity of the etchant passing in each header may be sensed by a sensor 151 and the information fed to the control circuit 147 to confirm that the command signal has been obeyed.

We claim:

1. In a method for producing a succession of articles from a strip of sheet metal whose thickness varies randomly along its length including (i) moving said strip along a prescribed path, (ii) and etching through said strip in defined regions thereof to a desired degree, said etching step having at least one variable process parameter that affects said degree of etching, the improvement comprising (a) monitoring the thickness of said strip along its direction of movement, (b) and adjusting said variable process parameter in response to said monitored thickness.

2. The method defined in claim 1 characterized in that said process parameter is the speed of said strip along said path.

3. The method defined in claim 1 characterized in that said process parameter is the speed of etching through said strip.

4. The method defined in claim 1 characterized in that said regions defined by etch-resistant stencils attached to said strip.

5. In a method for producing a succession of articles from a strip of sheet metal having randomly varying thickness along its length, said strip carrying etch-resistant stencils on both major surfaces thereof, said method including (i) moving said strip lengthwise along a prescribed path, (ii) and etching through successive regions of said strip from both surfaces thereof as defined by said stencils, the improvement comprising (a) monitoring the thickness of said strip along its direction of movement, (b) producing signals in response to the monitored thicknesses of said strip, and (c) adjusting the speed of said moving strip in response to said signals to compensate for said thickness variations.

6. The method defined in claim 5 characterized in that the thickness of said strip is monitored by passing a beam of x-rays of substantially constant intensity through said strip, whereby said intensity is attenuated as a function of the thickness of said strip, and then sensing the intensity of said attenuated beam.

7. The method defined in claim 5 characterized in that said strip is monitored for thickness at a succession of points along said strip, producing a succession of signals which are a function of the thicknesses of said strip.

8. The method defined in claim 7 characterized in that said succession of signals is processed to produce a most-recent running average signal for a prescribed most-recent time interval, said most-recent running average signal and the running average signal used for the last correction are subtracted one from the other to produce a difference signal, and then, provided said difference signal is larger than a prescribed threshold value, said difference signal is used to adjust the speed of said strip by a prescribed increment.

9. The method defined in claim 5 characterized in that said etching is conducted by contacting a turbulent spray of liquid etchant upon said major surfaces.

* * * * *

UNITED STATES PATENT AND TRADEMARK OFFICE
CERTIFICATE OF CORRECTION

PATENT NO. : 4,126,510

DATED : November 21, 1978

INVENTOR(S) : John Joseph Moscony and George Simon Gadbois

It is certified that error appears in the above-identified patent and that said Letters Patent is hereby corrected as shown below:

Column 5, line 28 change "spearate" to --separate--

Column 6, line 10 after "regions" insert --are--

Signed and Sealed this

Sixth Day of March 1979

[SEAL]

*Attest:*

RUTH C. MASON
*Attesting Officer*

DONALD W. BANNER
*Commissioner of Patents and Trademarks*